US005458794A

United States Patent [19]

Bardasz et al.

[11] Patent Number: 5,458,794

[45] Date of Patent: Oct. 17, 1995

[54] LUBRICANTS CONTAINING CARBOXYLIC ESTERS FROM POLYHYDROXY COMPOUNDS, SUITABLE FOR CERAMIC-CONTAINING ENGINES

[75] Inventors: Ewa A. Bardasz; Scott T. Jolley, both of Mentor; Christopher R. Sgarlata, Cleveland, all of Ohio

[73] Assignee: The Lubrizol Corporation, Wickliffe, Ohio

[21] Appl. No.: 129,897

[22] Filed: Sep. 30, 1993

[51] Int. Cl.[6] ..... C10M 107/22

[52] U.S. Cl. ..... 252/56 R; 252/56 S

[58] Field of Search ..... 252/56 R, 56 S

[56] References Cited

U.S. PATENT DOCUMENTS

| | | | |
|---|---|---|---|
| 2,798,083 | 7/1957 | Bell et al. | 554/213 |
| 2,997,491 | 8/1961 | Huber et al. | 554/168 |
| 3,148,147 | 9/1964 | Bell et al. | 252/47.5 |
| 3,247,111 | 4/1966 | Oberright et al. | 252/34.7 |
| 3,256,321 | 6/1966 | Durr et al. | 560/263 |
| 3,273,981 | 9/1966 | Furey | 44/349 |
| 3,282,971 | 11/1966 | Metro et al. | 554/227 |
| 3,341,574 | 9/1967 | Taylor et al. | 560/199 |
| 3,347,791 | 10/1967 | Thompson et al. | 252/33.6 |
| 3,441,600 | 4/1969 | Chao et al. | 560/263 |
| 4,438,005 | 3/1984 | Zoleski et al. | 252/33.4 |
| 4,477,383 | 10/1984 | Beimesch et al. | 252/56 S |
| 4,519,927 | 5/1985 | Seiki | 252/49.6 |
| 4,582,618 | 4/1986 | Davis | 252/32.7 E |
| 4,820,431 | 4/1989 | Kennedy | 252/56 R |
| 4,826,633 | 5/1989 | Carr et al. | 252/56 S |
| 4,879,052 | 11/1989 | Mullin | 252/32.5 |
| 5,021,179 | 6/1991 | Zehler et al. | 252/54.6 |
| 5,057,247 | 10/1991 | Schmid et al. | 252/565 |
| 5,236,610 | 8/1993 | Perez et al. | 252/56 S |
| 5,288,432 | 2/1994 | Jung | 252/56 S |

FOREIGN PATENT DOCUMENTS

| | | |
|---|---|---|
| 0571091 | 11/1993 | European Pat. Off. . |
| 1405551 | 5/1965 | France . |
| 46-002813B | of 1971 | Japan . |
| 55-017313 | 2/1980 | Japan . |
| 60-120739 | 6/1985 | Japan . |
| 61-260011 | 11/1986 | Japan . |
| 1245094 | 11/1990 | Japan . |
| 9113133 | 9/1991 | WIPO . |

OTHER PUBLICATIONS

Tsuya, Y., "Tribology of Ceramics", Proceedings of JSLE International Tribology Conference, 1985, p. 641.

Zum Gahr, K.—H., "Sliding Wear of Ceramic/Ceramic, Ceramic/Steel and Steel/Steel Pairs in Lubricated and Unlubricated Contact", Wear of Materials, 1989 p. 431, ASME.

Dufrane, K., "Wear Performance of Ceramics in Ring/Cylinder Applications", Ceramic Engineering and science, 9–10, 1988, p. 1409.

O'Connor, B. M., Hong, H., and Scott, C. A., "The Influence of Lubricant and Material Parameters in a Laboratory Valve Train Wear Test", Proceedings of the Japan International tribology conference, 1990, p. 2029.

"Development of High Temperature In–Cylinder Components and Tribological Systems for Advanced Diesel Engines," Larson, in Coordination Meeting, vol. I, Nov. 2–5, 1992.

The Merck Index, 1976, p. 658 (month unknown).

"Development of Advanced High Temperature In–Cylinder Components and Tribological System for Low Heat Rejection Diesel Engine," Owens, et al Preprints of the Annual Automotive Technology Development Contractors Coordination Meeting, vol. I, Nov. 2–5, 1992.

"Evaluation of High Temperature In–Cylinder Heat Transfer," Oren et al, Preprints of the Annual Automotive Technology Development Contractors Coordination Meeting, vol. I, Nov. 2–5, 1992.

*Primary Examiner*—Prince Willis, Jr.
*Assistant Examiner*—James M. Silbermann
*Attorney, Agent, or Firm*—David M. Shold; Frederick D. Hunter, Sr.

[57] ABSTRACT

Ceramic-containing engines are lubricated by compositions containing synthetic ester base stock. Suitable esters include those prepared from iso- and neo-acids of medium chain length and polyols including inositol.

2 Claims, No Drawings

LUBRICANTS CONTAINING CARBOXYLIC ESTERS FROM POLYHYDROXY COMPOUNDS, SUITABLE FOR CERAMIC-CONTAINING ENGINES

FIELD OF THE INVENTION

The present invention relates to a method for lubricating ceramic-containing engines and a class of lubricants suitable for such use.

BACKGROUND OF THE INVENTION

There has recently been interest in improving the fuel efficiency of internal combustion engines. One route to this goal has been research toward development of engines with ceramic components. Ceramic components are useful because they are generally believed to be able to withstand higher operating temperatures than can customary metal parts. Modified engines which make use of higher operating temperatures can exhibit more efficient fuel use and are sometimes operated with reduced cooling requirements. As a result, however, there is a need for lubricants useful in such ceramic-containing engines which exhibit good high temperature properties such as oxidative and thermal stability. This is particularly true since the lubricant is sometimes used as a coolant fuel for selective engine components (e.g. cylinder heads and liners and pistons). Furthermore, lubrication of ceramic parts, including ceramic-coated parts, i.e. ceramic-ceramic and ceramic-metal interfaces, can be more demanding than lubrication of ordinary metal-metal interfaces. This is in part because of the higher temperatures encountered, but also because of the greater hardness of ceramics, compared to metal, results in increased pressure and stress at points of contact. Moreover, the chemical interaction of ceramics with lubricants and lubricant additives can be different in certain respects from the chemical interaction with metals. Accordingly, the lubrication of ceramic-containing engines, and in particular high temperature, low heat rejection ceramic-containing engines, presents a technical challenge.

PCT publication WO 91/13133, Sep. 5, 1991, discloses a high temperature functional fluid comprising a synthetic base oil, at least one phenolic compound, and at least one non-phenolic antioxidant. The synthetic base oil can be synthetic ester oils including those prepared from polyhydric alcohols and alkanoic acids, including fatty acids which contain from 5 to about 30 carbon atoms such as saturated straight chain fatty acids or the corresponding branched chain fatty acids or unsaturated fatty acids. The functional fluids are useful as lubricating compositions for lubricating engines operating at high temperatures such as high temperature, low heat rejection diesel engines.

U.S. Pat. No. 4,879,052, Mullin, Nov. 7, 1989, discloses improving friction and fuel consumption especially for an adiabatic diesel engine, by use of a lubricant comprising polyol ester and triaryl phosphate. The polyol ester is e.g. trimethylol-propane tri-isostearate or trimethylolpropane tripelargonate.

SUMMARY OF THE INVENTION

The present invention provides a process for lubricating a ceramic-containing internal combustion engine comprising supplying to the engine a lubricant comprising at least one ester base fluid selected from the group consisting of:

(i) an ester of a polyhydroxy compound and a monocarboxylic acylating agent, and (ii) an ester of polyhydroxy compound and a combination of a dicarboxylic acylating agent and a monocarboxylic acylating agent;

and operating the engine.

In another aspect the invention the ester lubricant used in the process comprises at least one ester base fluid comprising at least one carboxylic ester of a polyhydroxy compound containing at least 2 hydroxyl groups and said ester being characterized by the general formula $$[R^1COO]_nR \qquad (I)$$

wherein:

R is a hydrocarbyl group;

each $R^1$ is independently hydrogen, a hydrocarbyl group, or a carboxylic acid- or carboxylic acid ester-containing hydrocarbyl group, where n is at least 2.

The present invention further provides an ester of a polyhydroxy compound moiety and an acylating agent, where the polyhydroxy moiety comprises a cyclohexane ring with at least 4 hydroxyl groups thereon, and where the acylating agent has at least 8 carbon atoms and is branched at the position α to the carboxy function.

DETAILED DESCRIPTION OF THE INVENTION

Throughout this specification and claims, all parts and percentages are by weight, temperatures are in degrees Celsius, and pressures are at or near atmospheric pressure unless otherwise clearly indicated.

As used in this specification and in the appended claims, the terms "hydrocarbyl" and "hydrocarbylene" denote a group having a carbon atom directly attached to the remainder of the molecule and having a hydrocarbon or predominantly hydrocarbon character within the context of this invention. Such groups include the following:

(1) Hydrocarbon groups; that is, aliphatic, (e.g., alkyl or alkenyl), alicyclic (e.g., cycloalkyl or cycloalkenyl), aromatic, and the like, as well as cyclic groups wherein the ring is completed through another portion of the molecule (that is, any two indicated substituents may together form an alicyclic group). Such groups are known to those skilled in the art. Examples include methyl, ethyl, octyl, decyl, octadecyl, cyclohexyl, etc.

(2) Substituted hydrocarbon groups; that is, groups containing non-hydrocarbon substituents which, in the context of this invention, do not alter the predominantly hydrocarbon character of the group. Those skilled in the art will be aware of suitable substituents. Examples include halo, hydroxy, alkoxy, etc.

(3) Hetero groups; that is, groups which, while predominantly hydrocarbon in character within the context of this invention, contain atoms other than carbon in a chain or ring otherwise composed of carbon atoms. Suitable hetero atoms will be apparent to those skilled in the art and include, for example, nitrogen, oxygen and sulfur.

In general, no more than three substituents or hetero atoms, and preferably no more than one, will be present for each 10 carbon atoms in the hydrocarbyl group.

Terms such as "alkyl", "alkylene", etc have meanings analogous to the above with respect to hydrocarbyl and hydrocarbylene.

The term "hydrocarbon-based" also has the same meaning and can be used interchangeably with the term hydrocarbyl when referring to molecular groups having a carbon atom attached directly to the polar group.

The term "lower" as used herein in conjunction with terms such as hydrocarbyl, hydrocarbylene, alkylene, alkyl, alkenyl, alkoxy, and the like, is intended to describe such groups which contain a total of up to 7 carbon atoms, per se, and includes methyl, ethyl, propyl, butyl, pentyl, hexyl, and heptyl groups.

Viscosity, unless otherwise indicated, is kinematic viscosity and is measured by ASTM D-2270.

For purpose of this invention, equivalent weight of polyol is determined by dividing the formula weight of the polyol by the number of hydroxyl groups. Equivalents of polyol is determined by dividing the amount of polyol by its equivalent weight. For polycarboxylic acylating agents or anhydrides, the equivalent weight is determined by dividing the formula weight of the acylating agent or anhydride by the number of carboxylic groups which form esters. For example, an anhydride contributes two carboxyl groups which can form ester. Therefore, the equivalent weight of anhydride, such as succinic anhydride, would be the formula weight of the anhydride divided by the number of carboxyl group. For succinic anhydride, the number is two.

The term "consisting essentially of" refers to compositions that include the ingredients listed in the claim as well as other ingredients that do not materially affect the basic and novel characteristics of the compositions.

The present invention relates to a process for lubricating a ceramic-containing internal combustion engine.

Ceramics can be generally described as inorganic solids prepared by the well-known process of sintering of inorganic powders. Inorganic powders in general can be metallic or non-metallic powders, but as used in the present invention they are normally non-metallic powders. Such powders may also be oxides or non-oxides of metallic or non-metallic elements. The inorganic powders may comprise inorganic compounds of one or more of the following metals or semi-metals: calcium, magnesium, barium, scandium, titanium, vanadium, chromium, manganese, iron, cobalt, nickel, copper, zinc, yttrium, niobium, molybdenum, ruthenium, rhodium, silver, cadmium, lanthanum, actinium, gold, rare earth elements including the lanthanide elements having atomic numbers from 57 to 71, inclusive, the element yttrium, atomic number 39, and silicon. The inorganic compounds include ferrites, titanates, nitrides, carbides, borides, fluorides, sulfides, hydroxides and oxides of the above elements. Specific examples of the oxide powders include, in addition to the oxides of the above-identified metals, compounds such as beryllium oxide, magnesium oxide, calcium oxide, strontium oxide, barium oxide, lanthanum oxide, gallium oxide, indium oxide, selenium oxide, etc. Specific examples of oxides containing more than one metal, generally called double oxides, include perovskite-type oxides such as $NaNbO_3$, $SrZrO_3$, $PbZrO_3$, $SrTiO_3$, $BaZrO_3$, $BaTiO_3$; spinel-type oxides such as $MgAl_2O_4$, $ZnAl_2O_4$, $CoAl_2O_4$, $NiAl_2O_4$, $NiCr_2O_4$, $FeCr_2O_4$, $MgFe_2O_4$, $ZnFe_2O_4$, etc.; illmenite-types oxides such as $MgTiO_3$, $MnTiO_3$, $FeTiO_3$, $CoTiO_3$, $ZnTiO_3$, $LiTaO_3$, etc.; and garnet-type oxides such as $Gd_3Ga_5O_{12}$ and rare earth-iron garnet represented by $Y_3Fe_5O_{12}$.

An example of non-oxide powders include carbides, nitrides, borides and sulfides of the elements described above. Specific examples of the carbides include SiC, TiC, WC, TaC, HfC, ZrC, AlC; examples of nitrides include $Si_3N_4$, AlN, BN and $Ti_3N_4$; and borides include $TiB_2$, $ZrB_2$ and $LaB_6$.

The inorganic powders may also be a clay. Examples of clays include kaolinite, nacrite, dickite, montmorillonite, nontronite, spaponite, hectorite, etc.

In one embodiment, the inorganic powder is silicon nitride, silicon carbide, zirconia, including yttria-stabilized zirconia, alumina, aluminum nitride, barium ferrite, barium-strontium ferrite or copper oxide. In another embodiment, the inorganic powder is alumina or clay. Preferably the ceramic is prepared from alumina, aluminum nitride, silicon carbide, barium ferrite copper oxide, or most preferably silicon nitride ($Si_3N_4$).

Organic binders may be included in the compositions of inorganic powder to facilitate the production of so-called "green bodies" as an intermediate step to preparation of the final ceramic material. Such green bodies can be produced by extrusion or injection molding, press molding or slip casting or other methods. The amount of binder included in the compositions is an amount which provides the desired properties for the green and sintered shapes. Generally, the compositions will contain 5% by weight of the binder based on the weight of the inorganic powder although larger amounts, such as to 30% by weight, can be utilized in some applications. The binder may be present in amounts greater than 0.5% by weight of the inorganic powder.

A variety of binders have been suggested and utilized in the prior art and can be utilized in preparing ceramics. Examples of these binders include starch, cellulose derivatives, polyvinyl alcohols, polyvinylbutyral, etc. Examples of synthetic resin binders include thermoplastic materials such as polystyrene, polyethylene, polypropylene and mixtures thereof. Other binders include vegetable oils, petroleum jelly and various wax-type binders which may be hydrocarbon waxes or oxygen-containing hydrocarbon waxes.

Sintering aids may also be used to facilitate formation of ceramic materials. Sintering aids can be organic or inorganic materials which improve properties of the final sintered product. Examples of inorganic materials include the hydroxides, oxides or carbonates of alkali metals, alkaline earth metals, and the transition metals including, in particular, the rare earth elements. Specific examples of inorganic sintering aids include calcium oxide, magnesium oxide, calcium carbonate, magnesium carbonate, zinc oxide, zinc carbonate, yttrium oxide, yttrium carbonate, zirconium oxide, zirconium carbonate, lanthanum oxide, neodymium oxide, samarium oxide, etc. Other traditional additives and components for formation of ceramics can also be used.

The formation of ceramics generally includes as a first step the dispersion of the inorganic powder in a liquid disperse medium. The amount of liquid disperse medium utilized may vary over a wide range although it is generally desirable to prepare compositions containing a maximum amount of the inorganic powder and a minimum amount of the disperse medium. The amount of liquid disperse medium utilized in any particular combination can be readily determined by one skilled in the art will depend upon the nature of the inorganic powder, the type and amount of dispersant, and any other components present in the composition. The amount of liquid dispersed medium present is usually from as low as 1–2%, generally 5%, preferably 10%, more preferably 15%, to 40%, preferably 35%, more preferably 30% by weight based on the amount of inorganic powder.

The liquid dispersing medium may be oxygenated or hydrocarbon in nature and is preferably volatile, to facilitate its removal. Oxygenated solvents include alcohols, esters, ketones and water as well as ethoxylated versions of the same. Combinations of these materials are also useful. Alkyl, cycloalkyl and aryl hydrocarbons, as well as petroleum fractions may also be used as liquid media. Included within these types are benzene and alkylated benzenes, cycloalkanes and alkylated cycloalkanes, cycloalkenes and alkylated cycloalkenes such as found in the naphthene-based petroleum fraction, and the alkanes such as found in the paraffin-based petroleum fractions.

Formation of a final ceramic part is generally accomplished by blending the above ingredients and shaping them in a mold, a still water press, or sheet mold. Alternatively, the blended mixture can be extrusion- or injection-molded to form a green body, or the mixture can be prepared by casting the mixture on a tape. The green body may also be prepared by spray-drying, rotary evaporation, etc. Following the formation of the mixture into the desired shape, the shaped mass is subjected to elevated temperature treatment (sintering). At this time the inorganic powders are sintered resulting in the formation of a shape having the desired properties including suitable densities. For ceramic processes, the sintering generally occurs from 600° C., preferably 700° C. up to 1700° C.

Among the many parts in an engine which may be made of ceramic or coated with a ceramic layer are tappets, camshafts, rocker arms, connecting rods, oil pump gears, pistons, piston rings, piston pins, cylinder liners, cylinder heads and cylinder head faces, intake and exhaust port liners, bearings, turbocharger parts, and the interior of the combustion chamber. Such parts can be entirely made of ceramics, or they can be metal parts which have a ceramic coating or lining. In addition, fibers of aluminum oxide, silicon carbide, or other ceramic materials can be used to reinforce specific metal parts. The engines themselves can be uncooled, air cooled, or cooled with a fluid such as an oil.

The lubricant in the present invention will typically be supplied to the engine from a sump by means of a pump, as in a traditional sump-lubricated spark-ignited gasoline engine or a sump-lubricated diesel engine, although other means can be used (as in a two-cycle compression-ignited diesel engine).

A characteristic of ceramic engines, and particularly of low heat rejection ceramic engines, is the relatively high temperatures at which they can operate. High temperature operation can result in higher theoretical fuel economy, since less of the energy of the fuel is spent as exhaust heat. The insulating effect of the ceramic materials can reduce heat transfer from the exhaust gas to other parts of the engine, improving intake volumetric efficiency and waste heat recovery efficiency (which can be effected by a turbocharger stage). Furthermore, such engines may be able to operate on a wider variety of fuels than lower temperature engines. However, high temperature operation puts greater demands on the lubricant for such an engine. The present invention is particularly useful for lubricating engines at temperatures of at least 250° C. or preferably at least 300° C. The temperature within an engine, of course, can vary greatly from location to location, but the temperatures referred to above are to be understood as measured within the cylinder wall at the top ring reversal (TRR) position. This location is the position of the greatest extent of travel of the uppermost piston ring in a compression or exhaust stroke.

The lubricant of the present invention contains at least one carboxylic ester of a monocarboxylic acylating agent, preferably having 4 to 15 carbon atoms, or a combination of a dicarboxylic acylating agent and a monocarboxylic acylating agent, again preferably having 4 to 15 carbon atoms, with a polyhydroxy compound containing at least two hydroxyl groups. The ester is characterized by the general formula $$[R^1COO]_nR \quad \text{(I)}$$

In formula (I) R is a hydrocarbyl group, each $R^1$ is independently hydrogen, a straight chain hydrocarbyl group, a branched chain hydrocarbyl group, each preferably containing from 3 to 14 carbon atoms, or a carboxylic acid- or carboxylic ester-containing hydrocarbyl group, and n is at least 2.

The carboxylic ester lubricants utilized in the present invention are reaction products of one or more carboxylic acylating agents, e.g. acids, anhydrides, acid chloride, or lower esters such as methyl or ethyl, with polyhydroxy compounds containing at least two hydroxyl groups. The polyhydroxy compounds may be represented by the general formula $$R(OH)_n \quad \text{(II)}$$

wherein R is a hydrocarbyl group and n is at least 2. The hydrocarbyl group will preferably contain 4 to 20 or more carbon atoms, and the hydrocarbyl group may also contain one or more nitrogen and/or oxygen atoms. The polyhydroxy compounds generally will contain from 2 to 10 hydroxyl groups and more preferably from 3 to 10 hydroxyl groups.

The polyhydroxy compound may contain one or more oxyalkylene groups, and, thus, the polyhydroxy compounds include compounds such as polyetherpolyols. The number of carbon atoms and number of hydroxyl groups contained in the polyhydroxy compound used to form the carboxylic esters may vary over a wide range.

The polyhydroxy compounds used in the preparation of the carboxylic esters (I) also may contain one or more nitrogen atoms. For example, the polyhydroxy compound may be an alkanolamine containing from 3 to 6 hydroxyl groups. In one preferred embodiment, the polyhydroxy compound is an alkanolamine containing at least two hydroxyl groups and more preferably at least three hydroxyl groups.

Specific examples of polyhydroxy compounds useful in the present invention include ethylene glycol, diethylene glycol, triethylene glycol, propylene glycol, dipropylene glycol, glycerol, neopentyl glycol, 1,2-, 1,3- and 1,4-butanediols, pentaerythritol, dipentaerythritol, tripentaerythritol, triglycerol, trimethylolpropane, di-trimethylolpropane, sorbitol, inositol, hexaglycerol, 2,2,4-tri- methyl-1,3-pentanediol, etc. Preferably, the mixtures of any of the above polyhydroxy compounds can be utilized.

The carboxylic acylating agents utilized in the preparation of the carboxylic esters useful in the liquid compositions can be characterized by the following general formula $$R^1COOH \quad \text{(III)}$$

wherein $R^1$ is hydrogen, a hydrocarbyl group (including alkyl, aryl, and alkaryl hydrocarbyl groups), preferably of 3 to 14 carbon atoms, or a carboxylic acid- or carboxylic acid ester-containing hydrocarbyl group. Aryl groups include groups containing one or more aromatic nuclei such as benzene nuclei, naphthalene nuclei, and the like, as well as substituted aryl groups. Alkaryl groups include alkyl-substituted aryl groups such as methylphenyl and aryl substituted alkyl groups such as phenylmethyl, phenylethyl, and so on. Preferably, at least one $R^1$ group in the ester product of Formula I should contain a straight chain hydrocarbyl group or a branched chain hydrocarbyl group. In one preferred embodiment, the branched chain hydrocarbon group contains from 5 to 20 carbon atoms and in a more preferred embodiment, contains from 5 to 14 carbon atoms.

In one embodiment, the branched chain hydrocarbyl groups are characterized by the structure $$-C(R^2)(R^3)(R^4)$$

wherein $R^2$, $R^3$ and $R^4$ are each independently alkyl groups, and at least one of the alkyl groups contains two or more carbon atoms. Such branched chain alkyl groups, when attached to a carboxyl group are referred to in the industry as neo groups and the acids are referred to a neo acid. The neo acids are characterized as having alpha-, alpha-, disubstituted hydrocarbyl groups. In one embodiment, $R^2$ and $R^3$ are methyl groups and $R^4$ is an alkyl group containing two or more carbon atoms.

Any of the above hydrocarbyl groups ($R^1$) may contain one or more carboxy groups or carboxy ester groups such as $-COOR^5$ wherein $R^5$ is a lower alkyl, hydroxyalkyl or a hydroxyalkyloxy group. Such substituted hydrocarbyl groups are present, for example, when the carboxylic acylating agent, $R^1COOH$ (III) is a dicarboxylic acylating agent or a monoester of a dicarboxylic acylating agent. Generally, however, the acid, $R^1COOH$ (III), is a monocarboxylic acid since polycarboxylic acids tend to form polymeric products if the reaction conditions and amounts of reactants are not carefully regulated. Mixtures of monocarboxylic acids and minor amounts of dicarboxylic acids or anhydrides are useful in preparing the esters (I).

Examples of carboxylic acylating agents containing a straight chain lower hydrocarbyl group include formic acid, acetic acid, propionic acid, butyric acid, valeric acid, hexanoic acid and heptanoic acid and anhydrides of any one thereof. Examples of carboxylic acylating agents wherein the hydrocarbyl group is a branched chain hydrocarbyl group include isobutyric acid, 2-ethyl-n-butyric acid, 2-methylbutyric acid, 2,2,4-trimethylpentanoic acid, 2-hexyldecanoic acid, isostearic acid, 2-methylhexanoic acid, 3,5,5-trimethylhexanoic acid, 2-ethylhexanoic acid, isooctanoic acid, isononanoic acid, isoheptanoic acid, isodecanoic acid, neoheptanoic acid, neodecanoic acid, and ISO Acids and NEO Acids available from Exxon Chemical Company, Houston, Tex. USA. ISO Acids are isomer mixtures of branched acids and include commercial mixtures such as ISO Heptanoic Acid, ISO Octanoic Acid, and ISO Nonanoic Acid, as well as developmental products such as ISO Decanoic Acids and ISO 810 Acid. Of the ISO Acids, ISO Octanoic acid and ISO Nonanoic acid are preferred. Neo acids include commercially available mixtures such as NEO Pentanoic Acid, NEO Heptanoic Acid, and NEO Decanoic Acid, as well as developmental products such as ECR-909 (NEO $C_9$) Acid, and ECR-903 (NEO $C_{1214}$) Acid and commercial mixtures of branched chain carboxylic acids such as the mixture identified as NEO 1214 acid from Exxon. The designation of an acid as "so" or "neo" generally refers to the branching structure at the $\alpha$ carbon atom; the remainder of the carbon chain may or may not have further branching.

In a preferred embodiment, the ester is prepared from one of the polyhydroxy compound described above and a monocarboxylic acylating agent having from 4, 5, or 6, up to 15, 14, or 12, carbon atoms. The monocarboxylic acylating agent may be linear or branched, preferably branched. Particularly useful monocarboxylic acylating agents include branched monocarboxylic acylating agents having 8 to 10 carbon atoms.

Another third type of carboxylic acylating agent which can be utilized in the preparation of the carboxylic esters are the acids containing a straight chain hydrocarbyl group containing 8 to 22 carbon atoms. Examples of such higher molecular weight straight chain acids include decanoic acid, dodecanoic acid, stearic acid, lauric acid, behenic acid, etc.

In another embodiment, the carboxylic acylating agents utilized to prepare the carboxylic esters may comprise a mixture of a major amount of monocarboxylic acylating agents and a minor amount of dicarboxylic acylating agents. Preferably the molar amount of monocarboxylic acylating agent is at least 3 times as great as the molar amount of the dicarboxylic acylating agent. Examples of useful dicarboxylic acylating agents include maleic acid or anhydride, succinic acid or anhydride, adipic acid or anhydride, oxalic acid or anhydride, pimelic acid or anhydride, glutaric acid or anhydride, suberic acid or anhydride, azelaic acid or anhydride, sebacic acid or anhydride, etc. The presence of the dicarboxylic acylating agents results in the formation of esters of higher viscosity. The complex esters are formed by having a substantial portion of the dicarboxylic acylating agents react with more than one polyol. The reaction is generally coupling of polyols through the dicarboxylic acylating agent or anhydride. Examples of mixtures of mono- and dicarboxylic acylating agents include succinic anhydride and 3,5,5-trimethylhexanoic acid; azelaic acid and 2,2,4-trimethylpentanoic acid; adipic acid and 3,5,5-trimethylhexanoic acid; sebacic acid and isobutyric acid; adipic and a mixture of 50 parts 3,5,5-trimethylhexanoic acid and 50 parts neoheptanoic acid; and neoheptanoic acid and a mixture of 50 parts adipic acid and 50 parts sebacic acid. The use of mixtures containing larger amounts of dicarboxylic acylating agents should generally be avoided since the product ester will contain larger amounts of polymeric esters, and such mixtures may have undesirably high viscosities. Viscosity and average molecular weight of the ester can be increased by increasing the amount of dicarboxylic acid and decreasing the amount of monocarboxylic acylating agent.

The carboxylic esters of Formula I and the liquid compositions are prepared, as mentioned above, by reacting at least one carboxylic acylating agent with at least one polyhydroxy compound containing at least two hydroxyl groups. The formation of esters by the interaction of carboxylic acylating agents and alcohols is acid catalyzed and is a reversible process which can be made to proceed to completion by use of a large amount of alcohol or carboxylic acylating agent, or by removal of the water as it is formed in the reaction. If the ester is formed by transesterification of a lower molecular weight carboxylic ester, the reaction can be forced to completion by removal of the low molecular weight alcohol formed by a transesterification reaction. The esterification reaction can be catalyzed by either organic acids or inorganic acids. Examples of inorganic acids include sulfuric acids and acidified clays. Various organic acids can be used including methanesulfonic acid, paratoluenesulfonic acid, and acidic resins such as Amberlyst 15. Organometallic catalysts include, for example, tetraisopropoxy orthotitanate.

The amounts of carboxylic acylating agents and polyhydroxy compounds included in the reaction mixture may be varied depending on the results desired. If it is desired to esterify all of the hydroxyl groups contained in the polyhydroxy compounds, sufficient carboxylic acylating agent should be included in the mixture to react with all of the hydroxyl groups. When mixtures of the acylating agents are reacted with a polyhydroxy compound in accordance with the present invention, the carboxylic acylating agents can be reacted sequentially with the polyhydroxy compounds or a mixture of carboxylic acylating agents can be prepared and the mixture reacted with the polyhydroxy compounds. In one embodiment wherein mixtures of acylating agents are utilized, the polyhydroxy compound is first reacted with one carboxylic acylating agent, generally, the higher molecular weight branched chain or straight chain carboxylic acylating agent followed by reaction with the straight chain lower hydrocarbyl carboxylic acylating agent.

Throughout the specification and claims, it should be understood that the esters also may be formed by reaction of the polyhydroxy compound with the anhydrides of any of the above-described carboxylic acids. For example, esters are easily prepared by reacting the polyhydroxy compounds either with acetic acid or acetic anhydride.

In one embodiment, the esters are made by reacting a polyol with a mixture of a dicarboxylic acylating agent and a monocarboxylic acylating agent. The amount of dicarboxylic acylating agent and monocarboxylic acylating agent may be varied to obtain a product for the desired result. In one embodiment, one equivalent of polyol is reacted with from 0.07, preferably from 0.17 to 0.33, preferably to 0.23 moles of dicarboxylic acylating agent and from 0.67, preferably from 0.77 to 0.93, preferably to 0.83 moles of monocarboxylic acylating agent. Of course, more than one equivalent of acylating agent, and particularly of monocarboxylic acid, may be used.

The formation of esters by the reaction of carboxylic acylating agents with the polyhydroxy compounds described above can be effected by heating the acylating agents, the polyhydroxy compounds, with or without a catalyst to an elevated temperature while removing water, or low molecular weight alcohols or acids formed in the reaction. Generally, temperatures of from 75° C. to 200° C., 230° C., or higher are sufficient for the reaction. The reaction is completed when water, or low molecular weight alcohol or acid is no longer formed, and such completion is indicated when water, or low molecular weight alcohols or acids can no longer be removed by distillation.

In some instances, it is desired to prepare carboxylic esters wherein not all of the hydroxyl groups have been esterified. Such partial esters can be prepared by the techniques described above and by utilizing amounts of the acid or acids which are insufficient to esterify all of the hydroxyl groups.

The following examples illustrate the preparation of various carboxylic esters which are used in the invention.

EXAMPLE 1

A mixture of 92.1 parts (1 mole) of glycerol and 316.2 parts of acetic anhydride is prepared and heated to reflux. The reaction is exothermic and continues to reflux at 130° C. for about 4.5 hours. Thereafter the reaction mixture is maintained at the reflux temperature by heating for an additional 6 hours. The reaction mixture is stripped by heating while blowing with nitrogen, and filtered with a filter aid. The filtrate is the desired ester.

EXAMPLE 2

A mixture of 872 parts (6.05 moles) of 2-ethylhexanoic acid, 184 parts (2 moles) of glycerol and 200 parts of toluene is prepared and blown with nitrogen while heating the mixture to about 60° C. Para-toluene sulfonic acid (5 parts) is added to the mixture which is then heated to the reflux temperature. A water/toluene azeotrope distills at about 120° C. A temperature of 125°–130° C. is maintained for about 8 hours followed by a temperature of 140° C. for 2 hours while removing water. The residue is the desired ester.

EXAMPLE 3

Into a reaction vessel there are charged 600 parts (2.5 moles) of triglycerol and 1428 parts (14 moles) of acetic anhydride. The mixture is heated to reflux in a nitrogen atmosphere and maintained at the reflux temperature (125°–130° C.) for about 9.5 hours. The reaction mixture is nitrogen stripped at 150° C. and 2.0 kPa (15 mm Hg). The residue is filtered through a filter aid, and the filtrate is the desired ester.

EXAMPLE 4

A reaction vessel is charged with 23 parts (0.05 mole) of hexaglycerol and 43.3 parts (0.425 mole) of acetic anhydride. The mixture is heated to the reflux temperature (about 139° C.) and maintained at this temperature for a total of about 8 hours. The reaction mixture is stripped with nitrogen and then vacuum stripped to 150° C. at 2.0 kPa (15 mm Hg). The residue is filtered through a filter aid, and the filtrate is the desired ester.

EXAMPLE 5

A mixture of 364 parts (2 moles) of sorbitol, and 340 parts (2 moles) of a commercial $C_{810}$ straight chain methyl ester (Procter & Gamble), is prepared and heated to 180° C. The mixture is a two-phase system. Para-toluene sulfonic acid (1 part) is added, and the mixture is heated to 150° C. whereupon the reaction commences and water and methanol evolve. When the solution becomes homogeneous, 250 parts (2.5 moles) of acetic anhydride are added with stirring. The reaction mixture then is stripped at 150° C. and filtered. The filtrate is the desired ester of sorbitol.

EXAMPLE 6

A mixture of 536 parts (4 moles) of trimethylolpropane and 680 parts (4 moles) of a commercial $C_{810}$ straight chain methyl ester is prepared, and 5 parts of tetraisopropoxy orthotitanate are added. The mixture is heated to 200° C. with nitrogen blowing. Methanol is distilled from the reaction mixture. When the distillation of methanol is completed by nitrogen blowing, the reaction temperature is lowered to 150° C., and 408 parts (4 moles) of acetic anhydride are added in a slow stream. A water azeotrope begins to evolve when 50 parts of toluene are added. When about 75 parts of a water/acetic acid mixture has been collected, the distillation ceases. Acetic acid (50 parts) is added and additional water/acetic acid mixture is collected. The acetic acid addition is repeated with heating until no water can be removed by distillation. The residue is filtered and the filtrate is the desired ester.

EXAMPLE 7

A mixture of 402 parts (3 moles) of trimethylolpropane, 660 parts (3 moles) of a commercial straight chain methyl ester comprising a mixture of about 75% $C_{12}$ methyl ester and about 25% $C_{14}$ methyl ester, (CE1270 from Procter & Gamble), and tetraisopropoxy orthotitanate is prepared and heated to 200° C. with mild nitrogen blowing. The reaction is allowed to proceed overnight at this temperature, and in 16 hours, 110 parts of methanol is collected. The reaction mixture is cooled to 150° C., and 100 parts of acetic acid and 50 parts of toluene are added followed by the addition of an additional 260 parts of acetic acid. The mixture is heated at about 150° C. for several hours yielding the desired ester.

EXAMPLE 8

A mixture of 408 parts (3 moles) of pentaerythritol and 660 parts (3 moles) of the CE1270 methyl ester used in Example 7 is prepared with 5 parts of tetraisopropyl orthotitanate, and the mixture is heated to 220° C. under a nitrogen purge. No reaction occurs. The mixture then is cooled to 130° C., and 250 parts of acetic acid are added. A small amount of para-toluenesulfonic acid is added and the mixture is stirred at about 200° C. for 2 days, and 60 parts of methanol are removed. At this time, 450 parts of acetic anhydride are added and the mixture is stirred at 150° C. until the acetic acid/water azeotrope no longer evolves. The residue is filtered through a filter aid, and the filtrate is the desired ester of pentaerythritol.

EXAMPLE 9

A mixture of 850 parts (6.25 moles) of pentaerythritol, 3250 parts (25 moles) of neoheptanoic acid, and 10 parts of tetraisopropoxy orthotitanate is prepared and heated to 170° C. Water is evolved and removed by distillation. When the evolution of water ceases, 50 parts of acidified clay are added and some additional water is evolved. A total of about 250 parts of water is removed during the reaction. The reaction mixture is cooled to room temperature and 310 parts of acetic anhydride are added to esterify the remaining hydroxyl groups. The desired ester is obtained.

EXAMPLE 10

A mixture of 544 parts (4 moles) of pentaerythritol, 820 parts (4 moles) of Neo 1214 acid, a commercial acid mixture available from Exxon, 408 parts (4 moles) of acetic anhydride and 50 parts of Amberlyst 15 is prepared and heated to about 120° C. whereupon water and acetic acid begin to distill. After about 150 parts of water/acetic acid are collected, the reaction temperature increases to about 200° C. The mixture is maintained at this temperature of several days and stripped. Acetic anhydride is added to esterify any remaining hydroxyl groups. The product is filtered and the filtrate is the desired ester.

EXAMPLE 11

A mixture of 1088 parts (8 moles) of pentaerythritol, 1360 parts (8 moles) of a commercial methyl ester of an acid mixture comprising about 55% of C8, 40% of $C_{10}$ and 4% of $C_6$ acids ("CE810 Methyl Ester", Procter & Gamble), 816 parts of acetic anhydride and 10 parts of paratoluene sulfonic acid is prepared and heated to reflux. About 500 parts of a volatile material are removed. A water azeotrope mixture then distills resulting in the removal of about 90 parts of water. Acetic anhydride (700 parts) is added and the mixture is stirred as a water/acetic acid mixture is removed. The reaction is continued until no more water is evolved and no free hydroxyl groups remain (by IR). The reaction product is stripped and filtered.

EXAMPLE 12

A mixture of 508 parts (2 moles) of dipentaerythritol, 812 parts (8 moles) of acetic anhydride, 10 parts of acidified clay as catalyst and 100 parts of xylene is prepared and heated to 100° C. This temperature is maintained until the solid dipentaerythritol is dissolved. A water/acetic acid azeotrope is collected, and when the rate of evolution diminishes, the reaction mixture is blown with nitrogen. About 100°–200 parts of acetic acid are added and the reaction is continued as additional water/acetic acid/xylene azeotrope is collected. When an infrared analysis of the reaction mixture indicates a minimum of free hydroxyl groups, the reaction mixture is stripped and filtered. The filtrate is the desired product which solidifies.

EXAMPLE 13

A mixture of 320 parts (1.26 moles) of dipentaerythritol, 975 parts (1.25 moles) of neoheptanoic acid and 25 parts of Amberlyst 15 catalyst is prepared and heated to 130° C. At this temperature water evolution is slow, but when the temperature is raised to 150° C., about 65% of the theory water is collected. The last amounts of water are removed by heating to 200° C. The product is a dark viscous liquid.

EXAMPLE 14

A mixture of 372 parts (1 mole) of tripentaerythritol, 910 parts (7 moles) of neoheptanoic acid and 30 parts of Amberlyst 15 catalyst is prepared and heated to 110° C. as water is removed. The mixture is heated for a total of 48 hours, and unreacted acid is removed by stripping the mixture. The residue is the desired ester.

EXAMPLE 15

A mixture of 1032 parts (6 moles) of neodecanoic acid, 450 parts (3 moles) of triethylene glycol and 60 parts of Amberlyst 15 is prepared and heated to 130° C. A water azeotrope is evolved and collected. The residue is the desired product.

EXAMPLE 16

A mixture of 1032 parts (6 moles) of neodecanoic acid and 318 parts (3 moles) of diethylene glycol is prepared and heated to 130° C. in the presence of 20 parts of Amberlyst 15. After heating for 24 hours and removing about 90 parts of water, 20 parts of Amberlyst 15 are added and the reaction is conducted for another 24 hours. The reaction is stopped when the theory amount of water is obtained, and the residue is the desired ester.

EXAMPLE 17

A reaction vessel is charged with 2010 parts (15 moles) of trimethylolpropane, 6534 parts (45 moles) of 2,2,4-trimethylpentanoic acid (available commercially from Exxon Corporation under the trade name ISO Octanoic acid), and 8 parts of methanesulfonic acid. The mixture is heated to 150° C. and water is removed. The temperature is increased to 200° C. and the temperature is maintained for eight hours. After water evolution, the reaction mixture is vacuum stripped to 200° C. and 2.7 kPa (20 mm Hg). The residue is filtered and the filtrate is the desired product. The product has a neutralization acid number of 0.06 and a kinematic viscosity of 32 cSt at 40° C.

EXAMPLE 18

A reaction vessel is charged with 2814 parts (21 moles) of trimethylolpropane, 6854 parts (67 moles) of isopentanoic acid (available commercially from Union Carbide), which is a mixture of 66% by weight valeric acid and 34% by weight 2-methylbutyric acid), 5 parts methanesulfonic acid, 50 parts of an aromatic solvent. The reaction mixture is heated to 145° C. over three hours. The reaction mixture is heated to 165° C. over three hours. The temperature of the mixture is maintained for 13 hours. A total of 1100 milliters of water is collected. The reaction mixture is vacuum stripped to 180°–200° C. and 1.3–2.0 kPa (10–15 mm Hg). The residue is filtered and the filtrate is the desired product. The product has a 0.009 acid number, and a kinematic viscosity of 10.2 cSt at 40° C. and 2.65 cSt at 100° C.

EXAMPLE 19

A reaction vessel is charged with 2345 parts (17.5 moles) of trimethylolpropane, and 8295 parts (52.5 moles) of 3,5,5 trimethylhexanoic acid (available commercially from Exxon Corporation under the trade name ISO Nonanoic acid). The mixture is heated to 150° C. and the temperature is maintained for 12 hours. The reaction mixture is then heated to 200° C. and the temperature is maintained for 38 hours. The reaction is then heated to 220° C. and the temperature is maintained for 14 hours. The reaction mixture is vacuum stripped to 200° C. and 1.3–2.0 kPa (10–15 mm Hg). Alumina (275 parts) is added to the residue and the residue is filtered. The filtrate is the desired product. The product has a zero acid number, and a kinematic viscosity of 52.8 cSt at 40° C. and 7.1 cSt at 100° C.

EXAMPLE 20

A mixture of 200 parts (2 moles) of succinic anhydride and 62 parts (1 mole) of ethylene glycol is heated to 120° C., and the mixture becomes a liquid. Five parts of acidic clay are added as catalyst, and an exotherm to about 180° C. occurs. Isooctanol (260 parts, 2 moles) is added, and the reaction mixture is maintained at 130° C. as water is removed. When the reaction mixture becomes cloudy, a small amount of propanol is added and the mixture is stirred at 100° C. overnight. The reaction mixture then is filtered to remove traces of oligomers, and the filtrate is the desired ester.

EXAMPLE 21

A mixture of 200 parts (2 moles) of succinic anhydride, 62 parts (1 mole) of ethylene glycol and i part of paratoluene sulfonic acid is prepared and heated to 80°–90° C. At this temperature, the reaction begins and an exotherm to 140° C. results. The mixture is stirred at 130°–140° C. for 15 minutes after 160 parts (2 moles) of 2,2,4-trimethylpentanol are added. Water evolves quickly, and when all of the water is removed, the residue is recovered as the desired product.

EXAMPLE 22

A mixture of 294 parts (3 moles) of maleic anhydride and 91 parts (1.5 moles) of ethylene glycol is prepared and heated at about 180° C. whereupon a strong exotherm occurs and the temperature of the mixture is raised to about 120° C. When the temperature of the mixture cools to about 100° C., 222 parts (3 moles) of n-butyl alcohol and 10 parts of Amberlyst 15 are added. Water begins to evolve and is collected. The reaction mixture is maintained at 120° C. until 50 parts of water is collected. The residue is filtered, and the filtrate is the desired product.

EXAMPLE 23

A mixture of 1072 parts (8 moles) of trimethylolpropane, 2080 parts (16 moles) of neoheptanoic acid and 50 parts of Amberlyst 15 is prepared and heated to about 130° C. A water/acid azeotrope evolves and is removed. When about 250 of the azeotrope has been removed, 584 parts (4 moles) of adipic acid are added and the reaction continues to produce an additional 450 parts of distillate. At this time, 65 parts of trimethylolpropane are added to the mixture and additional water is removed. The residue is filtered and the filtrate is the desired ester.

EXAMPLE 25

Esters are prepared by reacting mixtures of isononanoic acid (1) and adipic acid (2) with trimethylolpropane (3), in the presence of a tetraisopropoxy orthotitanate catalyst. The reactants are charged to a flask and heated until reaction ceases, as indicated by termination of water collection in a distillation trap, at which point the reaction mixture has reached about 220° C. A vacuum is applied to remove volatile components, and the flask contents are cooled and filtered to produce the liquid ester product.

Properties of the products are as follows:

| | Moles | | | Catalyst, | Viscosity, cSt | | Molecular |
|---|---|---|---|---|---|---|---|
| Product | (1) | (2) | (3) | grams | 40° C. | 100° C. | Weight |
| A | 44 | 2 | 16 | 13 | 76.6 | 9.1 | 611 |
| B | 40 | 4 | 16 | 12 | 116 | 12.3 | 694 |
| C | 16 | 2 | 6.7 | 5 | 141 | 13.9 | 723 |

As can be seen, increasing the fraction of dicarboxylic acid results in a higher viscosity, higher average molecular weight (as measured by vapor phase osmometry) ester material.

EXAMPLE 26

The procedure of Example 25 is used to prepare esters from isononanoic acid (1), adipic acid (2) and neopentylglycol (3), giving the following product properties:

| | Moles | | | Catalyst, | Viscosity, cSt | | Molecular |
|---|---|---|---|---|---|---|---|
| Product | (1) | (2) | (3) | grams | 40° C. | 100° C. | Weight |
| A | 2 | 1 | 2 | 2 | 80 | 10.5 | 588 |
| B | 10.7 | 6.7 | 12 | 5 | 106 | 13.2 | 665 |
| C | 8.3 | 8.3 | 12.5 | 8 | 220 | 22.1 | 758 |

EXAMPLE 27

The procedure of Example 25 is used to prepare esters from isononanoic acid (1), isooctanoic acid (2), isobutyric acid (3), adipic acid (4) and pentaerythritol (5), giving the following product properties:

| | Moles | | | | | Catalyst |
|---|---|---|---|---|---|---|
| Product | (1) | (2) | (3) | (4) | (5) | grams |
| A | 7 | 7 | 7 | 1.5 | 6 | 5 |
| B | 7.2 | 7.2 | 6 | 1.8 | 6 | 5 |

| | Viscosity, cSt | | Molecular |
|---|---|---|---|
| Product | 40° C. | 100° C. | Weight |
| A | 149.5 | 14.0 | 733 |
| B | 194 | 16.9 | 802 |

EXAMPLE 28

The procedure of Example 25 is used to prepare the ester in Table 3.

TABLE 3

| Example | Moles TMP(1) | Adipic Acid | iso Nonanoic Acid (2) |
|---|---|---|---|
| Comparative Example | 1 | 0 | 3 |
| 28A | 1 | 0.1 | 2.8 |
| 28B | 1 | 0.125 | 2.75 |
| 28C | 1 | 0.25 | 2.45 |
| 28D | 1 | 0.30 | 2.4 |
| 28E | 1 | 0.35 | 2.3 |

| | Viscosity @40° C. | @100° C. |
|---|---|---|
| Example | 52.25 | 7.25 |
| 28A | 69.4 | 8.65 |
| 28B | 76.6 | 9.14 |
| 28C | 119 | 12.3 |
| 28D | 140 | 14 |
| 2BE | 185 | 16.8 |

(1) TMP - Trimethylolpropane
(2) Available from Exxon Chemical Company

As can be seen from Table 3, as the level of dicarboxylic acid is increased, the viscosity of the ester increases.

The carboxylic ester lubricants preferably contain branched alkyl groups and in one embodiment are also free of acetylenic and aromatic unsaturation. In another embodiment, the ester lubricants of this invention also are substantially free of olefinic unsaturation except that some olefinic unsaturation may be present so long as the stability properties of the lubricant are retained.

Liquid compositions containing carboxylic esters derived from neo polyols such as neopentylglycol, trimethylolpropane and pentaerythritol, have particularly beneficial thermal and hydrolytic stability. Those derived from cyclic polyols such as inositol also have particularly good thermal stability. It is particularly desirable that the alcohol groups of the polyol are substantially completely esterified. Liquid compositions containing carboxylic esters derived from branched acids, such as iso or neo acids, preferably neo acids, have improved thermal and hydrolytic stability. In one embodiment, the carboxylic esters are derived from the above polyols, a polycarboxylic acid and an iso or neo acid. The liquid composition may contain one carboxylic ester reaction product or in another embodiment, the liquid compositions may contain a blend of two or more carboxylic ester reaction products. A liquid composition of a desired viscosity may be prepared by blending a higher viscosity carboxylic ester with a lower viscosity carboxylic ester.

Other additives which may be included in the liquid compositions of the present invention to enhance the performance of the liquids include extreme-pressure and anti-wear agents, oxidation and thermal-stability improvers, corrosion-inhibitors, viscosity-index improvers, pour point and/or floc point depressants, detergents including carbonate overbased detergents, dispersants, anti-foaming agents, viscosity adjusters, metal deactivators, etc. Included among the materials which may be used as extreme-pressure and anti-wear agents are phosphates, phosphate esters, thiophosphates such as zinc diorganodithiophosphates, chlorinated waxes, sulfurized fats and olefins, organic lead compounds, fatty acids, molybdenum complexes, borates, halogen-substituted phosphorous compounds, sulfurized Diels Alder adducts, organic sulfides, metal salts of organic acids, etc. Sterically hindered phenols, aromatic amines, dithiophosphates, sulfides and metal salts of dithioacids are useful examples of oxidation and thermal stability improvers. Compounds useful as corrosion-inhibitors include organic acids, organic amines, organic phosphates, organic alcohols, metal sulfonates, aromatic compounds containing sulfur, etc. VI improvers include polyolefins such as polyester, polybutene, polymethacrylate, polyalkyl styrenes, etc. Pour point and floc point depressants include polymethacrylates, ethylene- vinyl acetate copolymers, succinamic acid-olefin copolymers, ethylene-alpha olefin copolymers, etc. Detergents include sulfonates, long-chain alkyl-substituted aromatic sulfonic acids, phenylates, metal salts of alkyl phenols, alkyl phenol-aldehyde condensation products, metal salts of substituted salicylates, etc. Silicone polymers are a well known type of anti-foam agent. Viscosity adjusters are exemplified by polyisobutylene, polymethacrylates, polyalkyl styrenes, naphthenic oils, alkyl benzene oils, polyesters, polyvinyl chloride, polyphosphates, etc.

The following Examples 29–48 relate to formulations which are useful as the lubricant of the present invention. To each of the following ester base fluids is added an additive package comprising about 3 to about 5 percent by weight of a basic calcium salt of an $SCl_2$-coupled $C_2$-alkyl phenol sulfide, believed to have a structure much like

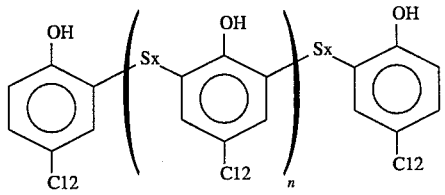

(where x is 1 or 2 and n is 0 to 3), about 1 to about 4 percent by weight of dinonylphenylamine, 30–80 parts per million of an antifoam agent, and about 4 to about 6 weight percent of diluent oil, comprised predominantly of poly-α-olefin oil.

| Ex. | Ester composition |
|---|---|
| 29 | trimethylolpropane/i-nonanoic acid/adipic acid mixed ester, 1:2.8:0.1 mole ratio |
| 30 | ester of Ex. 29, 2.4:1.0:0.3 mole ratio |
| 31 | trimethylolpropane/i-nonanoic acid ester, 1:3 mole ratio |
| 32 | pentaerythritol/i-nonanoic acid ester, 1:4 mole ratio |
| 33 | pentaerythritol/i-nonanoic acid/i-octanoic acid/i-butyric acid/adipic acid mixed ester, 1:1.17:1.16:0.025 mole ratio |
| 34 | pentaerythritol/tripentaerythritol/i-nonanoic acid/i-octanoic acid/i-butyric anhydride mixed ester, 1:1.17:1.17:1.16:0.025 mole ratio |
| 35 | dipentaerythritol/i-nonanoic acid/i-butyric acid mixed ester, 1:4:1 mole ratio |
| 36 | pentaerythritol/dipentaerythritol/i-nonanoic acid/i-butyric anhydride mixed ester, 1.0:0.67:7:0.5 mole ratio |
| 37 | pentaerythritol/i-nonanoic acid/i-butyric acid mixed ester, 1:3:0.5 mole ratio |
| 38 | pentaerythritol/i-nonanoic acid/i-butyric anhydride mixed ester, 1:3:0.5 mole ratio |
| 39 | dipentaerythritol/i-nonanoic acid/i-butyric anhydride |

-continued

| Ex. | Ester composition |
|---|---|
| | mixed ester, 1:4:1 mole ratio |
| 40 | trimethylolethane/neodecanoic acid ester, 1:3 mole ratio |
| 41 | neopentyl glycol/i-nonanoic acid/adipic acid mixed ester, 1.78:1.11:2 mole ratio |
| 42 | trimethylolpropane/neodecanoic acid ester, 1:3 mole ratio (reactants charged at 1:3.5 ratio to assure complete reaction of alcohol) |
| 43 | di-trimethylolpropane/neodecanoic acid ester, 1:4 mole ratio (reactants charged at 1:4.5 ratio) |
| 44 | the ester of claim 29 plus about 0.5% by weight of the product of cresylic acid, phosphorus pentasulfide, and zinc oxide |
| 45 | the ester of claim 30 plus about 1% by weight of dibutyl phosphate and about 0.05 weight percent tolyl benzotriazole |
| 46 | the ester of claim 34 plus about 20% of a butanol ester of α-olefin/dicarboxylic acid copolymer composition (a commercial composition sold under the name Ketjenlube ™) and about 1% of a butylated triphenyl phosphate |
| 47 | sorbitol/isononanoic acid, 1:6 mole ratio (reactants charged at 1:6.6 mole ratio) |

EXAMPLE 48

To a 1 L flask equipped with a stirrer, condenser, thermometer, and Dean-Stark trap, is added 90 g inositol (1,2,3,4,5,6-hexahydroxycyclohexane), 525 g isononanoic acid, and 2 g methanesulfonic acid. The mixture is heated under a nitrogen flow of 28.3 L/hour (1.0 scfh) to about 175° C. for 1 hour, then to 200° C. for 6 hours, then to 220° C. until no additional water of reaction is collected (about 17 hours). The mixture is cooled to 175° C. and an additional 100 g i-nonanoic acid is charged to the flask. The mixture is heated to 220° C. for 28 hours and the disappearance of the OH absorbance is monitored by infrared spectroscopy. The mixture is stripped for 6 hours at 200° C., cooled, and then filtered using a sintered glass funnel and a filter aid. The product is believed to be inositol hexa-isononanoate. It is useful as a general high-temperature lubricant.

EXAMPLE 49

Example 48 is repeated except that in place of the inositol, 98.4 g of protoquercitol (1,2,3,4,5-pentahydroxycyclohexane) is used.

EXAMPLE 50

To the ester used in Example 29 is added 6 weight percent carbonate overbased magnesium mono- and dialkylbenzenesulfonate, 285 conversion, about 1 weight percent dinonyldiphenylamine, and about 2 weight percent diluent oil, predominantly the ester of trimethylolpropane and isononanoic acid.

EXAMPLE 51

To the ester used in Example 34 is added about 6 weight percent calcium salicylate, metal ratio 1:1.1, about weight percent dinonyldiphenylamine, and about 3 weight 2 percent diluent oils, predominantly poly e-olefin oils.

EXAMPLE 52

Example 43 is repeated except that the amount of the calcium salt of the alkyl phenol sulfide is 5% by weight.

EXAMPLE 53

Example 42 is repeated except that the amount of the calcium salt of the alkyl phenol sulfide is 9% by weight and the amount of the diluent oil is about 12%.

The formulations of Examples 29–53 are evaluated by thermogravimetric analysis and by high temperature deposit/oxidation tests.

EXAMPLE 54

A mixture is prepared of 90 parts by weight of the ester of Example 40 and 10 parts by weight of the ester of Example 48.

Each of the documents referred to above is incorporated herein by reference. Except in the Examples, or where otherwise explicitly indicated, all numerical quantities in this description specifying amounts of materials, molecular weights, number of carbon atoms, reaction conditions, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade.

What is claimed is:

1. A process for lubricating an internal combustion engine containing at least one lubricant-requiring ceramic part, said process comprising:

(a) supplying to the engine a lubricant comprising at least one ester base fluid selected from the group consisting of esters of inositol and a monocarboxylic acylating agent; and (b) operating the engine.

2. A process for lubricating an internal combustion engine containing at least one lubricant-requiring ceramic part, said process comprising:

(a) supplying to the engine a lubricant comprising at least one ester base fluid comprising at least one carboxylic ester of a polyhydroxy compound containing at least 2 hydroxyl groups and said ester being characterized by the general formula $$[R^1COO]_nR \quad (I)$$

wherein:

R is a hydrocarbyl radical corresponding to inositol;

each $R^1$ is independently hydrogen, a hydrocarbyl group, or a carboxylic acid or carboxylic acid ester-containing hydrocarbyl group, where n is at least 3; and (b) operating the engine.

* * * * *

UNITED STATES PATENT AND TRADEMARK OFFICE

Certificate

Patent No. 5,458,794 Patented: October 17, 1995

On petition requesting issuance of a certificate for correction of inventorship pursuant to 35 U.S.C. § 256, it has been found that the above-identified patent, through error and without any deceptive intent, improperly sets forth the inventorship.

Accordingly, it is hereby certified that the correct inventorship of this patent is: Ewa A. Bardasz; Scott T. Jolley, both of Mentor; Christopher R. Sgarlata, Cleveland, Thomas F. Steckel, Chagrin Falls, all of Ohio.

Signed and Sealed this Twenty-second Day of April, 1997.

PRINCE WILLIS, JR.
*S.P.E. ART UNIT 1111*
Patent Examining Group 1100/2900
General, Metallurgical, Inorganic,
Petroleum, Electrical Chemistry, and
Engineering, and Designs